US007249674B2

(12) United States Patent
Mu et al.

(10) Patent No.: US 7,249,674 B2
(45) Date of Patent: Jul. 31, 2007

(54) MULTI-FUNCTIONAL SHOE STORAGE BOX

(76) Inventors: Der Liang Mu, 5915 Finecrest Dr., Rancho Palos Verdes, CA (US) 90275; Lisa Lynn Kim, 5915 Finecrest Dr., Rancho Palos Verdes, CA (US) 90275

( * ) Notice: Subject to any disclaimer, the term of this patent is extended or adjusted under 35 U.S.C. 154(b) by 0 days.

(21) Appl. No.: 11/161,810

(22) Filed: Aug. 17, 2005

(65) Prior Publication Data

US 2007/0039840 A1 Feb. 22, 2007

(51) Int. Cl.
*B65D 5/46* (2006.01)
*B65D 81/28* (2006.01)
*B65D 85/18* (2006.01)

(52) U.S. Cl. ..... 206/278.1; 206/278; 206/213; 206/808; 229/117.12; 229/117.19

(58) Field of Classification Search ..... 206/278, 206/278.1, 213, 808; 229/117.12, 117.19; 220/8, 476, 480
See application file for complete search history.

(56) References Cited

U.S. PATENT DOCUMENTS 1,076,076 A * 10/1913 Story ..... 229/117.24
1,781,624 A * 11/1930 Barnes ..... 206/758
2,226,112 A * 12/1940 Blechman ..... 312/31
2,565,969 A * 8/1951 Judson ..... 190/15 R
3,974,898 A * 8/1976 Tullis et al. ..... 190/3
4,795,029 A * 1/1989 Campbell et al. ..... 206/278
4,819,795 A * 4/1989 Swaney ..... 206/278
5,037,165 A * 8/1991 Rapp et al. ..... 312/330.1
5,269,408 A * 12/1993 Otis et al. ..... 206/288
5,509,170 A * 4/1996 LoFaro et al. ..... 15/265
6,491,212 B1 * 12/2002 Militzer ..... 229/125.125
6,732,858 B1 * 5/2004 Chang Ou ..... 206/278
2002/0092787 A1 * 7/2002 Cheng ..... 206/459.5

FOREIGN PATENT DOCUMENTS

DE 3330107 A1 * 3/1985
JP 2003 312641 A * 11/2003
WO WO 2004/099032 A1 * 11/2004

* cited by examiner

*Primary Examiner*—Sue A. Weaver
(74) *Attorney, Agent, or Firm*—IPLA P.A.; James E. Bame

(57) ABSTRACT

A multi-functional shoe storage box comprises a substantially transparent outer container defined by a bottom plate and first to fourth side plates, the first and second side plates facing each other, the third side plate facing the bottom plate, an opposing side of the fourth side plate being a side opening. A substantially transparent inner container defined by a bottom plate and first to fourth side plates, an opposing side of the inner container bottom plate being a top opening, the inner container first and second plates facing each other, the inner container third and fourth plates facing each other, whereby the inner container is slid through the side opening in and out of the outer container. A substantially transparent side tab extends from the outer container bottom plate and adjacent to the side opening, the side tab having a hole.

22 Claims, 4 Drawing Sheets

MULTI-FUNCTIONAL SHOE STORAGE BOX

BACKGROUND OF THE INVENTION

The present invention relates to a shoe storage box and, more particularly, to a multi-functional shoe storage box realizing see-through transparency to meet esthetic demand, wall-mount capacity to enhance product reliability, and deodorant application to maximize users' satisfaction.

Conventional shoe storage boxes come with paper containers. One of the disadvantages of the conventional paper shoe storage boxes is that each cover has to be opened for display on shoe racks and thus shoe pairs displaced to a different shoe storage box and tainted, thereby causing annoyances to the seller. Further, considering the shopper usually sees the label on the shoe storage box first, the inconveniences generated by the open paper shoe storage boxes, like unmatched design or shoe size by the frequent displacements, would probably disappoint the shoppers and affect the business itself.

A demand on the market is to provide a shoe storage box that allows shoppers to shop shoes in clean and convenient manners while shop owners enjoy a variety of display options to attract shoppers and satisfy shoppers needs.

Another demand is to introduce a shoe box that allows a user to see the shoes through the box container without opening the box.

SUMMARY OF THE INVENTION

The present invention is contrived to overcome the conventional disadvantages. Accordingly, an objective of the present invention is to provide a multi-purpose shoe storage box realizing see-through transparency to meet esthetic demand, wall-mount capacity to enhance product reliability, and deodorant application to maximize users' satisfaction.

Another objective is to provide a multi-functional shoe storage box satisfying convenience and display options as well as storage purpose.

A further objective is to provide a multi-functional shoe storage box adopting clear and transparent see-through mechanism enabling clear view of the shoe pair inside without opening the box container.

A still further objective is to provide a multi-functional shoe storage box enabling space saving stackable design.

To achieve these and other objectives, a multi-functional shoe storage box according to the present invention comprises a substantially transparent outer container defined by a bottom plate and first to fourth side plates, the first and second side plates facing each other, the third side plate facing the bottom plate, an opposing side of the fourth side plate being a side opening. A substantially transparent inner container is defined by a bottom plate and first to fourth side plates, an opposing side of the inner container bottom plate being a top opening, the inner container first and second plates facing each other, the inner container third and fourth plates facing each other, whereby the inner container is slid through the side opening in and out of the outer container. A substantially transparent side tab extends from the outer container bottom plate and adjacent to the side opening, where the side tab has a hole. The side tab extends straight from the bottom plate of the outer container.

The fourth side plates of the containers are each indented from atop, where the third side plate of the inner container is indented from atop to communicate with the indentation of the fourth side plate of the outer container. The fourth side plate of the inner container is holed below the indentation thereof to form a ventilation opening while providing a grip for a pull-out of the inner container from the outer container.

In a preferred mode, a ridge rail carried on and along each ridge of the side plates of the inner container to smooth the slide of the inner container, and the containers and the side tab are each formed of one selected from transparent polypropylene and transparent polyvinyl chloride.

The first side plate may have an outer slot so that an elongate handle whose ends are detachably and controllably fitted in a pair of inner slots formed through the inner container first side plate. In this construction, when the inner container is slid and closed in the outer container the handle becomes exposed through the outer slot to facilitate carriage of the box. The elongate handle is preferably formed of a flexible material.

Further provided is a deodorant panel disposed against the inner third plate and within the inner container. The deodorant panel is detachably attached to the inner container third plate. The deodorant panel is formed of a natural material, preferably of cedar.

Advantages of the present invention are numerous in that: (1) the multi-functional shoe storage box adopts a sidewise sliding mechanism in which the inner container is slid into the outer container; (2) the wall-mount mechanism enables shoe stores to display shoe boxes in a wide variety of decorative layouts and serves to escalate product satisfaction coupled with the clear and transparent see-through characteristics enabling clear view of the shoe pair inside without opening the box; and (3) the deodorant panel applied within the inner container minimizes a user's discomfort resulting from limited ventilation, thereby improving usability and marketability.

Although the present invention is briefly summarized, the full understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
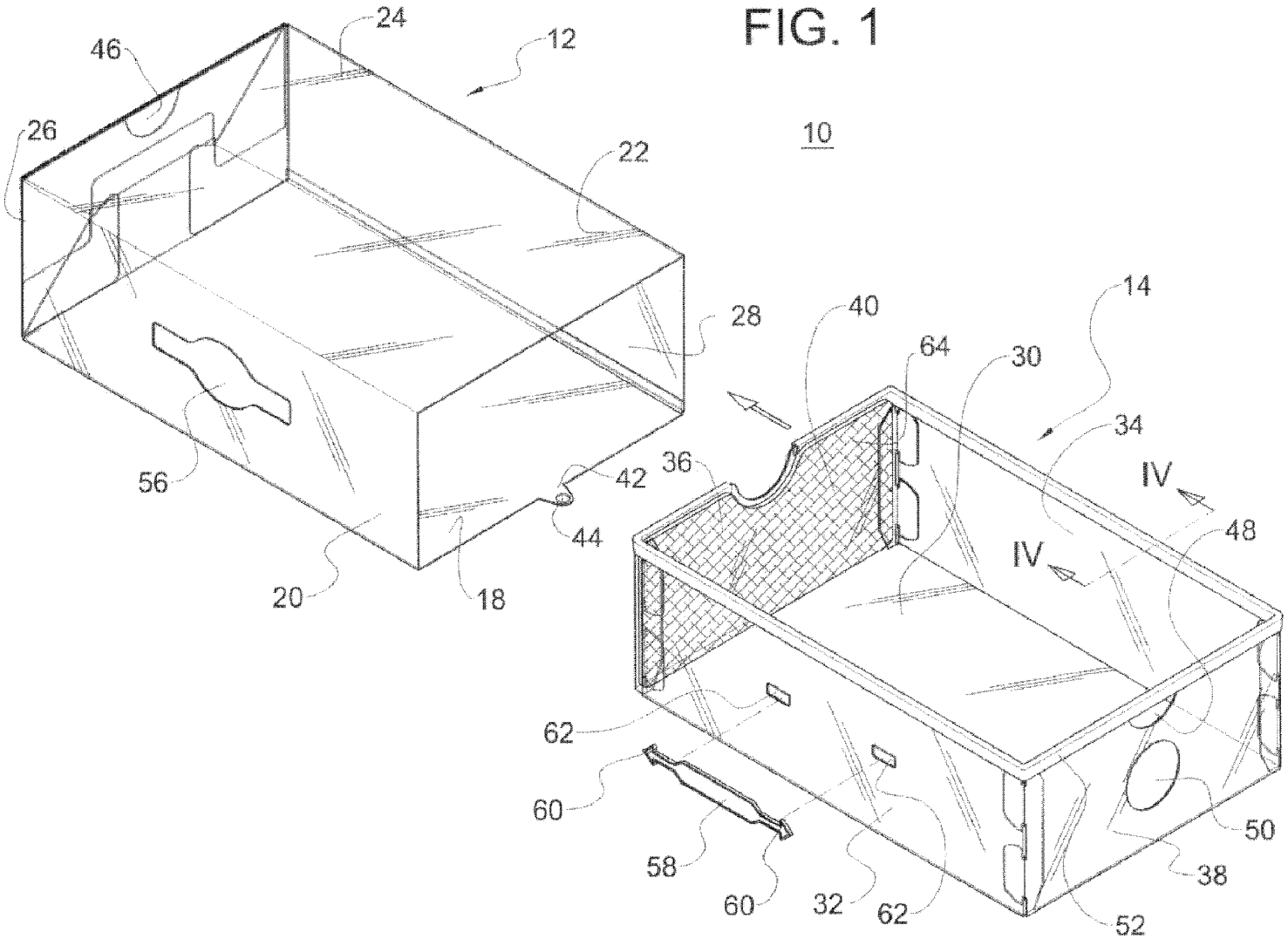
FIG. 1 is a construction view showing assembly of a multi-functional shoe storage box according to the present invention.
Figure 2:
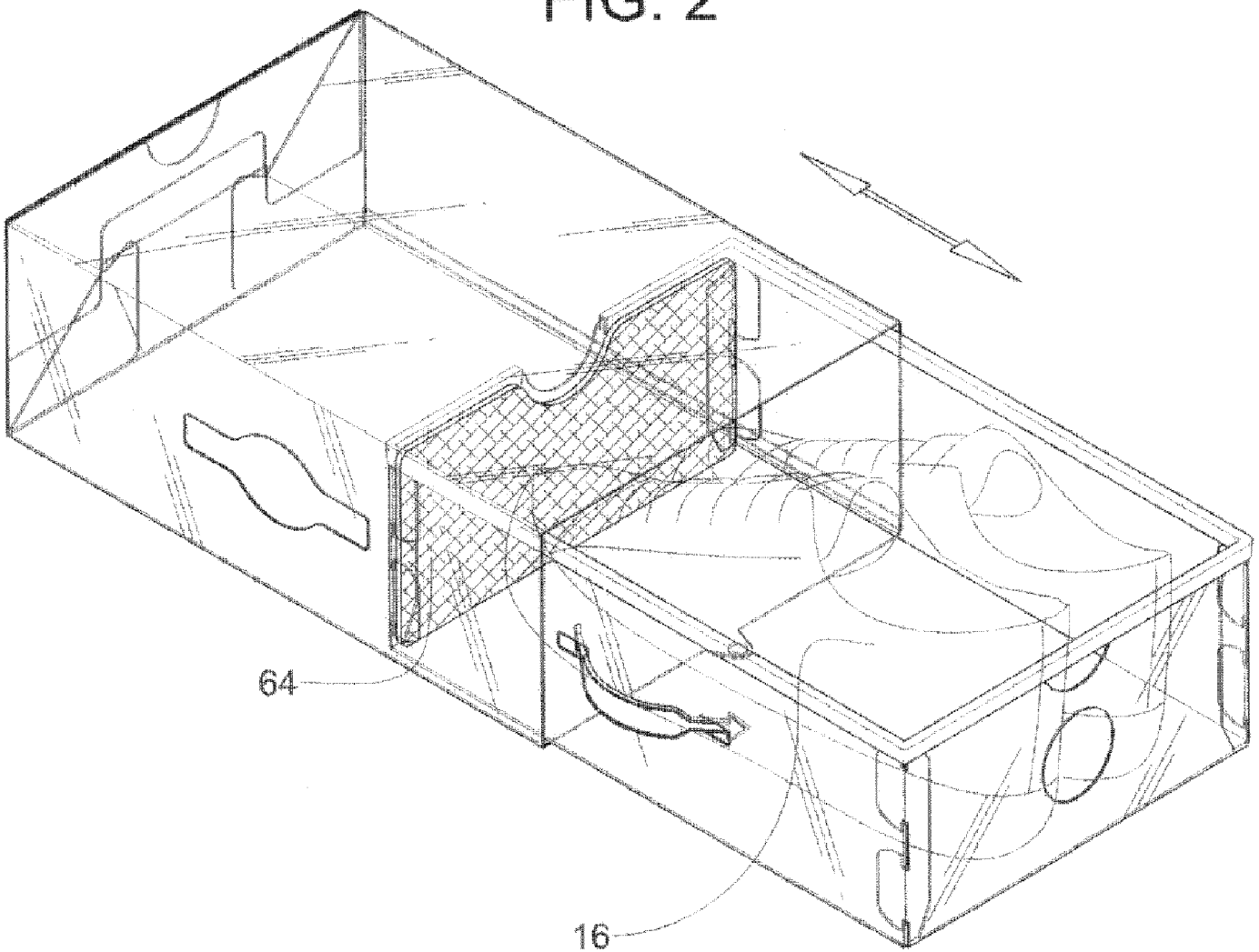
FIG. 2 is an application view showing a shoe storage of the multi-functional shoe storage box according to the present invention.
Figure 3:
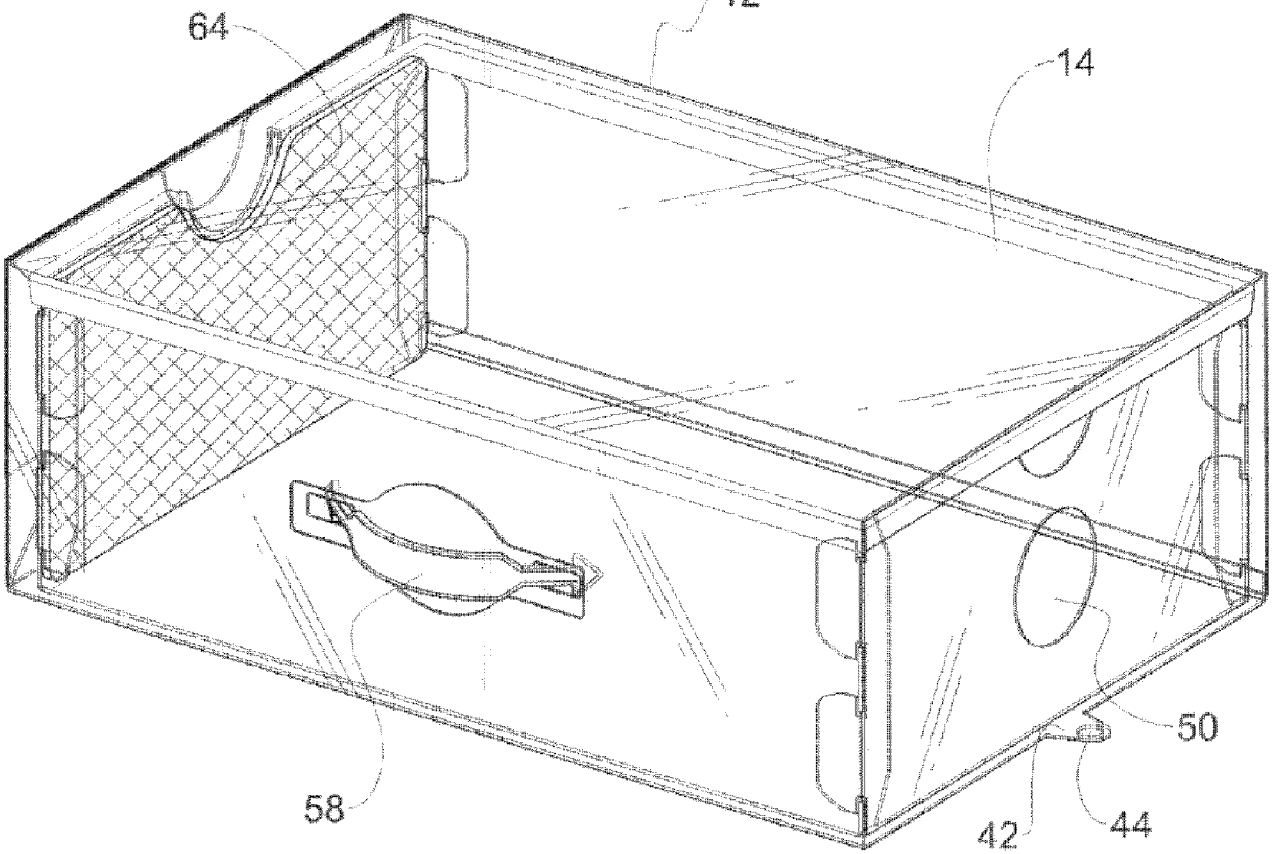
FIG. 3 is a perspective view of the present invention.

FIGS. 1 to 3 sequentially show construction and application of a multi-functional shoe storage box 10 according to the present invention. As shown therein, the shoe storage box 10 includes an outer container 12 and an inner container 14. The outer container 12 is characterized to have substantial transparency and also the inner container 14 carries substantial transparency in characteristics to allow a user to view through the transparent containers 12, 14 shoes 16 stored in the inner container 14.

The substantially transparent outer container 12 is preferably defined by a bottom plate 18 and first to fourth side plates 20, 22, 24, 26. The first and second side plates 20, 22 are aligned to face each other, and the third side plate 24 is aligned to face the bottom plate 18 whereas an opposing side of the fourth side plate 26 is open to have a side opening 28. It is preferred that an aerial plane of the side opening 28 is as large as the fourth side plate 26. Here, the fourth side plate 26 and the side opening 28 are each less than any other side plate of the outer container 12.

In order to fit in the outer container 12, the substantially transparent inner container 14 is defined by a bottom plate 30 and first to fourth side plates 32, 34, 36, 38. An opposing side of the bottom plate 30 of the inner container 14 is open to have a top opening 40 so that the shoes 16 can be placed within the inner container 14 for storage. The first and second plates 32, 34 of the inner container 14 is aligned to face each other, and the third and fourth plates 36, 38 of the inner container 14 are aligned to face each other to complete the inner container 14, whereby the inner container 14 is slid through the side opening 28 in and out of the outer container 12 with the shoes 16 placed in the inner container 14.

To improve usability of the shoe storage box 10, there is provided a substantially transparent side tab 42 extending from the bottom plate 18 and adjacent to the side opening 28 of the outer container 12. The side tab 42 is provided to have a hole 44 so that the shoe storage box 10 can be hooked on a shoe store wall for display or decoration purposes. It is recommended that the side tab 42 in this mechanism is formed to extend straight from the bottom plate 18 of the outer container 12 to facilitate wall mount of the shoe storage box 10.

In an embodiment, the fourth side plates 26, 38 of the containers 12, 14 are each indented from atop to secure ventilation of the shoe storage box 10 and easy grip to the user. For a better performance, the third side plate 36 of the inner container 14 is also indented from atop to communicate with the indentation 46 of the fourth side plate 26 of the outer container 12 to provide an aerial passage for ventilation between interior and exterior of the shoe storage box 10 in addition to an easy grip to the user.

The fourth side plate 38 of the inner container 14 is holed below the indentation 48 thereof to form a ventilation opening 50 while providing an easier grip for a pull-out of the inner container 14 from the outer container 12. So the user can utilize the indentations 46, 48, 50 for manipulation of the shoe storage box 10 by simply hooking a user's fingers in the indentations and ventilation opening 46, 48, 50.

Figure 4:
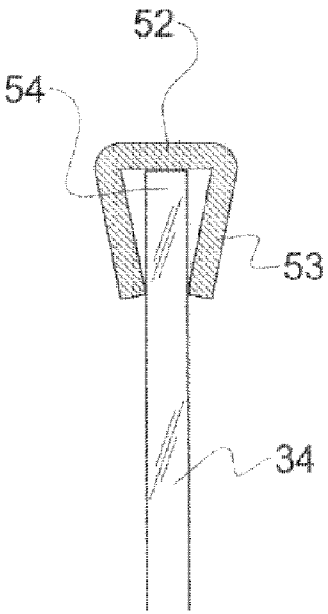
FIG. 4 is a cross-sectional view taken along line IV-iV in FIG. 1.

FIG. 4 shows a ridge rail mechanism. As shown therein, the shoe storage box 10 further comprises a ridge rail 52 carried on and along each ridge 54 of the side plates 32, 34, 36, 38 of the inner container 14 to smooth the slide of the inner container 14. That is, the ridge rail 52 serves to minimize friction between the plate ridge 54 of the inner container 14 and the third plate 24 of the outer container 12. Further, the ridge rail 52 is provided to sustain downward pressure when a plurality of shoe storage boxes 10 are vertically stacked. The ridge rail 52 has elastic wings 53 to removably hold each ridge 54.

To secure transparency characteristics of the shoe storage box 10, the containers 12, 14 and the side tab 42 are each formed of one selected from transparent polypropylene (PP) and transparent polyvinyl chloride PVC).

In a preferred embodiment, the substantially transparent outer container 12 is formed such that the first side plate 20 has an outer slot 56 to receive an elongate handle 58 from the inner container 14. Here, each end 60 of the elongate handle 58 is detachably and controllably fitted in a pair of inner slots 62 formed through the inner container first side plate 32 so that when the inner container 14 is slid and closed in the outer container 12, the handle 58 becomes exposed through the outer slot 56 of the outer container 12 to facilitate carriage of the shoe storage box 10.

The elongate handle 58 is preferably formed of a flexible material with elasticity, such as flexible plastic and flexible polyvinyl chloride. When the elongate handle 58 is removed from the inner container 14 can be used as a storage box for other purposes. For example, the inner container 14 can be used as CD storage box.

For the best performance, the shoe storage box 10 further comprises a deodorant panel 64 disposed against the inner third plate 36 and within the inner container 14. The deodorant panel 64 serves to provide fragrance and to deodorize the shoe storage box 10. Preferably, the deodorant panel is formed equal to or slightly less than the third side plate 36 of the inner container 14 so as to stably fit within the inner container 14. In this construction, the deodorant panel 64 is detachably attached to the inner container third side plate 36. The deodorant panel 64 is formed of a natural material. In a preferred version, the deodorant panel 64 is formed of cedar.

Figure 7:
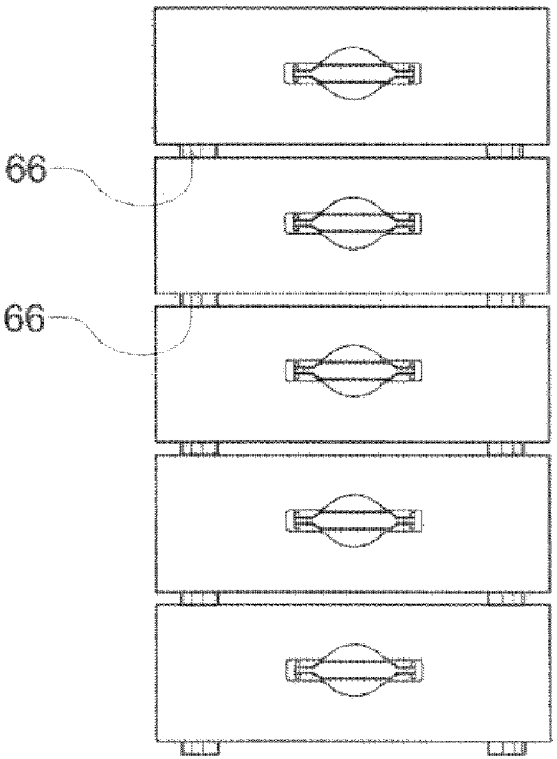
FIG. 7 is a view showing a plurality of shoe boxes stacked in a vertical format according to the present invention.
Figure 5:
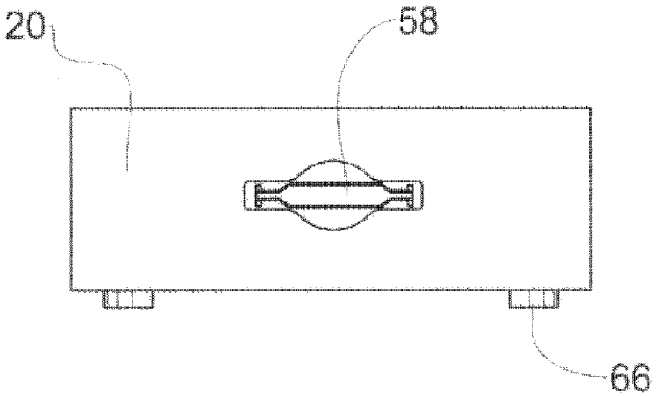
FIG. 5 is a schematic front view of the shoe storage box.
Figure 6:
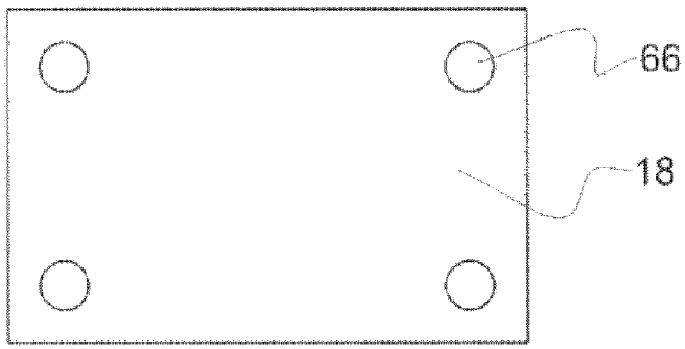
FIG. 6 is a schematic bottom view of the shoe storage box.

As shown in FIGS. 5-7, the shoe storage box 10 further comprises a plurality of pads 66 beneath the outer bottom plate 18 to facilitate vertical stacking of a plurality of shoe boxes 10. The pads 66 are preferably formed of rubber material to minimize horizontal sliding of the stacked boxes as illustrated in FIG. 7. Selectively, the pads 66 may be formed of plastic material depending upon market requirements.

To maximize the see-through characteristics of the shoe storage box 10, each and every part is possibly formed of a transparent material except the deodorant panel 64. Specifically, the containers 12, 14, side tab 42, and elongate handle 58 are each formed of one selected from transparent polypropylene (PP) for transparency and durability, and transparent polyvinyl chloride (PVC) for better transparency quality.

As discussed above, an advantage of the shoe storage box 10 is that the multi-functional shoe storage box 10 adopts a sidewise sliding mechanism in which the inner container 14 is slid into the outer container 14. Further, the wall-mount mechanism by the provision of the side tap 42 enables shoe stores to display shoe boxes 10 in a wide variety of decorative layouts and serves to escalate product satisfaction in furtherance of transparent see-through characteristics enabling clear view of the shoe pair 16 inside without opening the box 10. In addition, the deodorant panel 64 applied within the inner container 14 minimizes a user's discomfort resulting from limited ventilation, thereby improving usability and marketability.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. A multi-functional shoe storage box, comprising:

a) a substantially transparent outer container defined by a bottom plate and first to fourth side plates, the first and second side plates facing each other, the third side plate facing the bottom plate, an opposing side of the fourth side plate being a side opening;

b) a substantially transparent inner container defined by a bottom plate and first to fourth side plates, an opposing side of the inner container bottom plate being a top opening, the inner container first and second plates facing each other, the inner container third and fourth plates facing each other, whereby the inner container is slid through the side opening in and out of the outer container, wherein each of the first to fourth side plates comprises a ridge along a top portion thereof; and c) a substantially transparent side tab extending from the outer container bottom plate and adjacent to the side opening, the side tab having a hole, wherein the side tab extends straight from and lies on a substantially identical plane with the bottom plate of the outer container.

2. The shoe storage box of claim 1 further comprising pads attached beneath the outer bottom plate.

3. The shoe storage box of claim 1 wherein each of the fourth side plates of the containers comprises an indentation that is indented from atop, wherein the third side plate of the inner container comprises an indentation that is indented from atop to communicate with the indentation of the fourth side plate of the outer container.

4. The shoe storage box of claim 3 wherein the fourth side plate of the inner container is holed below the indentation thereof to form a ventilation opening while providing a grip for a pull-out of the inner container from the outer container.

5. The shoe storage box of claim 1 further comprising a ridge rail carried on and along each of the ridges of the side plates of the inner container to smooth the slide of the inner container.

6. The shoe storage box of claim 1 wherein the containers and the side tab are each formed of one selected from transparent polypropylene and transparent polyvinyl chloride.

7. A multi-functional shoe storage box, comprising:

a) a substantially transparent outer container defined by a bottom plate and first to fourth side plates, the first side plate having an outer slot, the first and second side plates facing each other, the third side plate facing the bottom plate, an opposing side of the fourth side plate being a side opening;

b) a substantially transparent inner container defined by a bottom plate and first to fourth side plates, an opposing side of the inner container bottom plate being a top opening, the inner container first and second plates facing each other, the inner container third and fourth plates facing each other, whereby the inner container is slid through the side opening in and out of the outer container, wherein each of the first to fourth side plates comprises a ridge along a top portion thereof;

c) a substantially transparent side tab extending from the outer container bottom plate and adjacent to the side opening, the side tab having a hole, wherein the side tab extends straight from and lies on a substantially identical plane with the bottom plate of the outer container; and d) an elongate handle whose ends are detachably and controllably fitted in a pair of inner slots formed through the inner container first side plate so that when the inner container is slid and closed in the outer container the handle becomes exposed through the outer slot to facilitate carriage of the box.

8. The shoe storage box of claim 7 further comprising pads attached beneath the outer bottom plate.

9. The shoe storage box of claim 7 wherein the elongate handle is formed of a flexible material.

10. The shoe storage box of claim 7 wherein each of the fourth side plates of the containers comprises an indentation that is indented from atop, wherein the third side plate of the inner container comprises an indentation that is indented from atop to communicate with the indentation of the fourth side plate of the outer container.

11. The shoe storage box of claim 10 wherein the fourth side plate of the inner container is holed below the indentation thereof to form a ventilation opening while providing a grip for a pull-out of the inner container from the outer container.

12. The shoe storage box of claim 7 further comprising a ridge rail carried on and along each of the ridges of the side plates of the inner container to smooth the slide of the inner container.

13. The shoe storage box of claim 7 wherein the containers and the side tab are each formed of one selected from transparent polypropylene and transparent polyvinyl chloride.

14. A multi-functional shoe storage box, comprising:

a) a substantially transparent outer container defined by a bottom plate and first to fourth side plates, the first side plate having an outer slot, the first and second side plates facing each other, the third side plate facing the bottom plate, an opposing side of the fourth side plate being a side opening;

b) a substantially transparent inner container defined by a bottom plate and first to fourth side plates, an opposing side of the inner container bottom plate being a top opening, the inner container first and second plates facing each other, the inner container third and fourth plates facing each other, whereby the inner container is slid through the side opening in and out of the outer container, wherein each of the first to fourth side plates comprises a ridge along a top portion thereof;

c) a substantially transparent side tab extending from the outer container bottom plate and adjacent to the side opening, the side tab having a hole, wherein the side tab extends straight from and lies on a substantially identical plane with the bottom plate of the outer container;

d) an elongate handle whose ends are detachably and controllably inserted in a pair of inner slots formed through the inner container first side plate so that when the inner container is slid and closed in the outer container the handle becomes exposed through the outer slot to facilitate carriage of the box; and e) a deodorant panel disposed against the fourth plate of and within the outer container.

15. The shoe storage box of claim 14 further comprising pads attached beneath the outer bottom plate.

16. The shoe storage box of claim 14 wherein the deodorant panel is detachably attached to the outer container fourth plate.

17. The shoe storage box of claim 14 wherein the deodorant panel is formed of a natural material.

18. The shoe storage box of claim 14 wherein the deodorant panel is formed of cedar.

19. The shoe storage box of claim 14 wherein each of the fourth side plates of the containers comprises an indentation that is indented from atop, wherein the third side plate of the inner container comprises and indentation that is indented from atop to communicate with the indentation of the fourth side plate of the outer container.

20. The shoe storage box of claim 19 wherein the fourth side plate of the inner container is holed below the indentation thereof to form a ventilation opening while providing a grip for a pull-out of the inner container from the outer container.

21. The shoe storage box of claim 14 further comprising a ridge rail carried on and along each of the ridges of the side plates of the inner container to smooth the slide of the inner container.

22. The shoe storage box of claim 14 wherein the containers and the side tab are each formed of one selected from transparent polypropylene and transparent polyvinyl chloride.

* * * * *